US005547029A

United States Patent [19]

Rubbo et al.

[11] Patent Number: 5,547,029

[45] Date of Patent: Aug. 20, 1996

[54] SURFACE CONTROLLED RESERVOIR ANALYSIS AND MANAGEMENT SYSTEM

[76] Inventors: Richard P. Rubbo, Bait Al-Na-Ba, Den of Cults, Aberdeen AB1 9NN, Scotland, United Kingdom; Brett W. Boundin, 4012 Cartagena, Pearland, Tex. 77581; Steven C. Owens, 6019 Fernhollow Ct., Katy, Tex. 77449

[21] Appl. No.: 315,122

[22] Filed: Sep. 27, 1994

[51] Int. Cl.[6] ..... E21B 43/00

[52] U.S. Cl. ..... 166/375; 166/65.1

[58] Field of Search ..... 166/374, 375, 166/65.1, 66.5

[56] References Cited

U.S. PATENT DOCUMENTS 4,942,926 7/1990 Lessi ..... 166/375 X 5,236,047 8/1993 Pringle et al. ..... 166/65.1 X 5,273,113 12/1993 Schultz ..... 166/65.1 X 5,376,545 12/1994 Laurent ..... 166/65.1 X

*Primary Examiner*—William P. Neuder

[57] ABSTRACT

A well control system for providing surface control of downhole production tools in a well. The well control system is capable of detecting well conditions and of generating command signals for operating one or more well tools. An electric conductor transmits electric signals, and a hydraulic line containing pressurized hydraulic fluid provides the power necessary to operate downhole tools. The invention provides a unique system for providing redundant conductors and redundant hydraulic lines to the well tool to continue operation if an electric conductor or hydraulic line becomes disabled. The well control tool also permits the selective operation of multiple production zones in a producing well.

37 Claims, 3 Drawing Sheets

SURFACE CONTROLLED RESERVOIR ANALYSIS AND MANAGEMENT SYSTEM

BACKGROUND OF THE INVENTION

The present invention relates to the production of hydrocarbon fluids from a reservoir. More particularly, the present invention relates to a production well analysis and management system that can be operated from the well surface.

The recovery of hydrocarbon fluids such as oil and gas from a subsurface reservoir or well requires downhole production equipment to control the hydrocarbon fluid flow. This production equipment typically includes tubing to convey the fluids from the geologic formation to the well surface, packers to isolate discrete hydrocarbon producing zones, and other tools to monitor and control fluid flow from the producing zones.

Well production operations are complicated by variables such as multiple producing zones having different fluid chemical compositions, fluid migration from one producing zone to another, differing temperatures and formation pressures, and the variable performance of each producing zone over time. These variables significantly influence the management of a well and further affect the ultimate recoverability of hydrocarbons from the well. Existing production well control systems do not efficiently monitor and control these variables in a multiple zone well.

Production well control systems are encumbered by the direct and indirect costs of obtaining production fluid data, by the uncertainty in predicting reservoir response to modified tool parameters, by the direct and indirect cost of well interventions, and by the risk and uncertainty associated with mechanical interventions. Certain existing intervention techniques irrevocably affect reservoir production and do not permit the return of the reservoir or well equipment to the original state.

At present, downhole well conditions are typically monitored by a single guage installed in a side pocket mandrel above the production packer. The data is communicated to the well surface with an electric conductor. The guage can measure fluid pressure and temperature and is retrievable to the well surface with a wireline. Such guages provide limited information regarding the production parameters of the entire well because the guages do not measure the temperature and formation fluid pressure at each discrete interval in a multiple zone well.

In addition to the need for information regarding well conditions, a need exists for systems to operate production equipment. Hydraulic lines providing hydraulic power have been used to remotely control certain downhole devices such as safety valves. Such valves are held in an open position when the hydraulic line is pressurized, and are closed by a spring driven actuator when the pressure in the hydraulic line is reduced. To increase the reliability of a safety valve, a redundant hydraulic line can be engaged with a second actuator to close the valve if the primary system fails. This redundancy increases the reliability of the operating system but does not increase the actual reliability of the safety valve.

If a safety valve is located at a relatively shallow depth in a vertical well, the probability of hydraulic line damage is slight. However the probability of hydraulic line damage increases at greater depths and in horizontal wells. In deep vertical wells, potentially destructive contact between the hydraulic lines and the wellbore is increased during installation of the production well tools. In horizontal wells, the production tubing and attached hydraulic lines rest against the lower side of the borehole and can be damaged. Such hydraulic lines cannot be efficiently secured to the upper side of the production tubing because the production tubing often twists in a helical fashion during tubing installation.

If the hydraulic line redundancy in subsurface safety valves was adapted to a horizontal well section, multiple hydraulic lines and actuators would be required for each tool. In a tool string with five downhole tools, five discrete hydraulic lines would be required to provide primary tool control, and ten discrete hydraulic lines would be required to provide primary and redundant power for each tool. This configuration is unwieldly and would complicate installation and control of well production equipment.

Although electric lines could theoretically control the operation of downhole well tools, such electric lines cannot carry sufficient current to operate certain downhole tools. To provide the requisite power, large and cumbersome electric conductors would complicate the design and operation of a multiple tool well production system. Additionally, electric conductors in horizontal wells would be exposed to the destructive forces caused by the tubing as it rests against the lower part of the wellbore.

Accordingly, a need exists for a well control system that permits the remote control of well production tools. The well control system should provide for cyclical control of the well tools and should provide reliable operation of the well tools in adverse environments such as horizontal and deep vertical wells.

SUMMARY OF THE INVENTION

The present invention provides a well control system for communication between the well surface and a downhole well tool. The control system has a hydraulic line engaged with the tool, a control means engaged with the well tool for selectively operating the tool, and a conductor for transmitting electric signals between the well surface and the control means. In other embodiments of the invention, the control means is capable of detecting a well condition, of transmitting a signal to a surface controller, and of receiving a command signal from the surface controller to control the operation of the tool.

In other embodiments of the invention, a second hydraulic line is engaged with the tool, and either hydraulic line is selectively isolated if the operability of such hydraulic line becomes impaired. Similarly, a second electric conductor is engaged with the control means, and either conductor can be selectively isolated if the operability of such conductor becomes impaired. The second hydraulic line can be split from a main hydraulic line substantially extending from the well surface to the tool, and the second electric conductor can be split from a main conductor substantially extending from the well surface to the control means.

The method of the invention is practiced by positioning a surface controller at the well surface, by placing a hydraulic line in communication with a downhole tool having a control means engaged with the tool, and placing a conductor in communication between the surface controller and the control means for transmitting electric signals therebetween.

DESCRIPTION OF THE PREFERRED EMBODIMENTS

The present invention independently monitors and controls a hydrocarbon producing well from the well surface. In a preferred embodiment of the invention, at least two isolated well zones are selectively monitored and produced. The invention provides a surface controlled reservoir and management system that uniquely overcomes the hazards present in horizontal and in deep vertical wells.

Figures 1, 6:
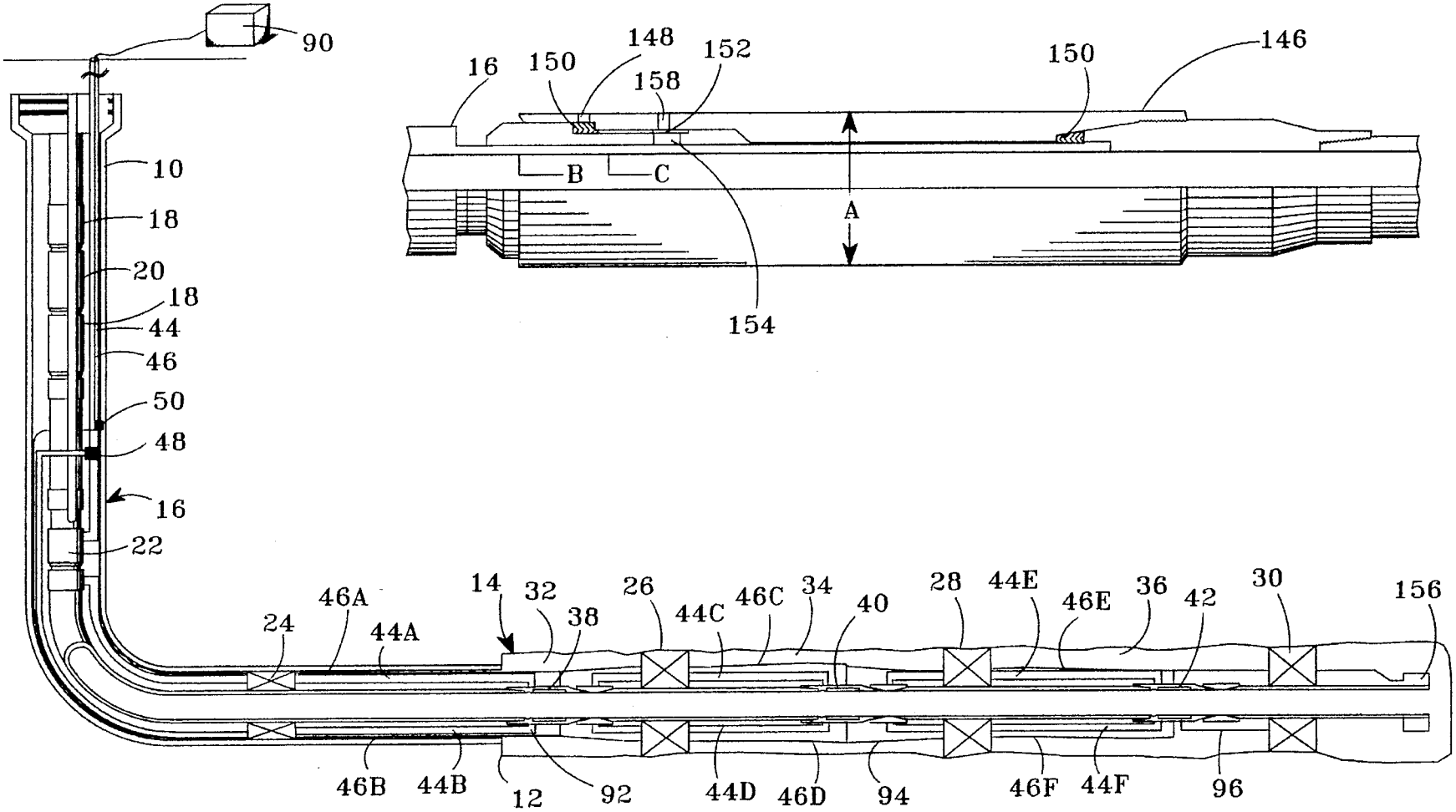
FIG. 1 illustrates an elevational view of a production tubing in a horizontal well.
FIG. 6 illustrates a sliding sleeve in one embodiment of the present invention.

Referring to FIG. 1, a schematic of a horizontal well is illustrated. Casing 10 and casing shoe 12 are positioned in wellbore 14. Production tubing 16 is connected with flow couplings 18 to tubing retrievable safety valve 20, and wet disconnect sub 22 can also be connected to production tubing 16. Production packer 24 fills the annulus between production tubing 16 and wellbore 14 to prevent the flow of fluids into such annulus. Production packer 24 and external casing packers 26, 28 and 30 define production zones 32, 34 and 36 respectively. Sliding sleeves 38, 40 and 42 are connected with production tubing 16 to selectively permit the flow of well fluids into production tubing 16 from production zones 32, 34, and 36.

As shown in FIG. 1, main hydraulic control line 44 and main electrical instrument wire 46 respectively extend from the well surface to hydraulic splitter 48 and instrument wire splitter 50. Hydraulic line sections 44A and 44B end in production zone 32, line sections 44C and 44D are in production zone 34, and 44E and 44F are in production zone 36 to provide redundant hydraulic power in the event that the corresponding paired hydraulic line section fails or otherwise experiences impairment of hydraulic fluid flow due to the restriction of flow, crushing forces, or rupture. Similarly, instrument wire sections 46A and 46B ending in production zone 32, wire sections 46C and 46D in production zone 34, and wire sections 46E and 46F in production zone 36, all provide redundancy in the event of electric current impairment or failure. In an alternative embodiment of the invention, two hydraulic lines and two instrument wires could extend to the well surface without being split as shown in FIG. 1.

Although multiple zones and sliding sleeves are illustrated in FIG. 1, the combination of hydraulic line 44 and instrument wire 46 could terminate at sliding sleeve 38 in production zone 32 to provide the combination of hydraulic power and electric control. As described more thoroughly below for this embodiment of the invention, sliding sleeve 38 can include a control means (not shown) engaged with instrument wire 46 for sending and receiving electric signals through instrument wire 46. Hydraulic line 44 provides the power necessary to operate sliding sleeve 38, and provides such operating power more efficiently than electric devices powered by current transmitted through instrument wire 46.

Figure 2:
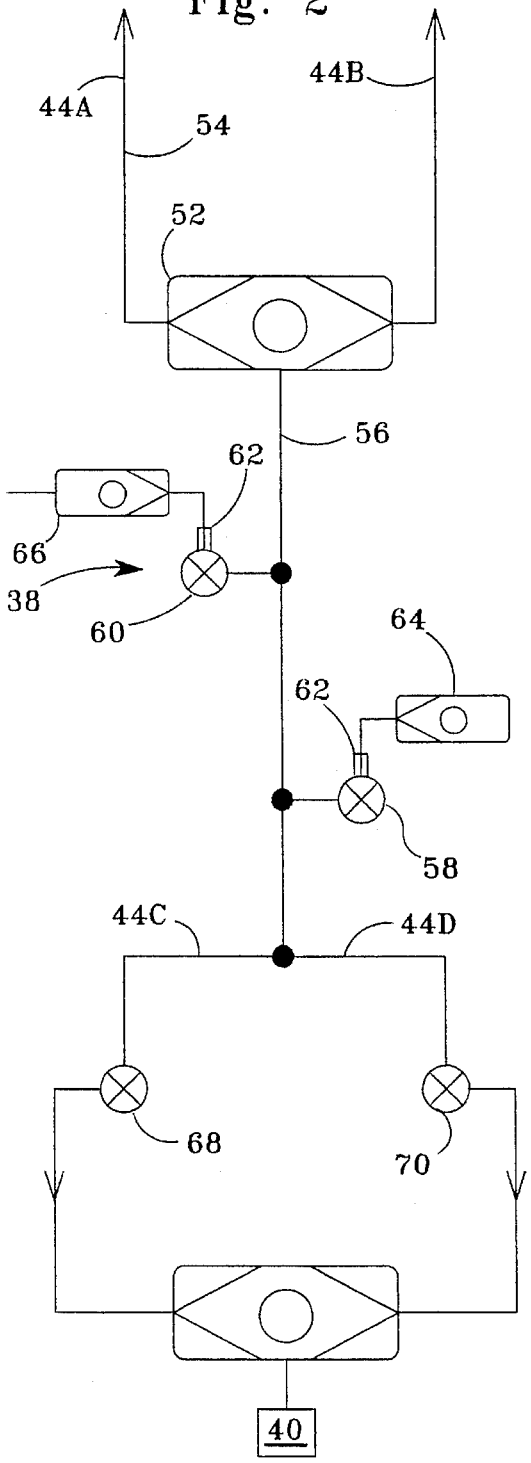
FIG. 2 illustrates a schematic drawing of redundant hydraulic lines.

Referring to FIG. 2, details of hydraulic control line sections 44A, 44B, 44C and 44D in production zone 32 are illustrated. As shown, hydraulic line sections 44A and 44B are engaged with two way check valve 52. Pressurized hydraulic fluid 54 in hydraulic line sections 44A and 44B contacts two way check valve 52 in normal operation. If either of hydraulic line sections 44A or 44B become damaged, check valve 52 would isolate the damaged hydraulic line. This feature prevents the complete escape of hydraulic fluid 54 from the well control system and permits continued operation of the well control system due to this bypass function.

Internal hydraulic line 56 is positioned downstream from check valve 52 and is engaged with a well tool such as sliding sleeve 38. Sliding sleeve 38 includes open solenoid valve 58 and close solenoid valve 60. In one embodiment of sliding sleeve 38, solenoid valves 58 and 60 are closed and sliding sleeve 38 remains stationary. When open solenoid valve 58 is opened, hydraulic fluid 54 travels from internal hydraulic line 54 and exerts a force on piston 62 in solenoid valve 58. Fluid on the opposite side of piston is forced out one-way check valve 64 into wellbore 14 so that an opposing force is not created. One way check valve 66 provides a similar function in the closing mode.

Internal hydraulic line 56 is split into line sections 44C and 44D which are respectively controlled with flow valves 68 and 70. Normally both valves 68 and 70 are open and hydraulic fluid 54 can provide a motive force on the next sliding sleeve 40. Either hydraulic line section 44C or 44D can be isolated by one of the corresponding flow valves 68 or 70 when a break in the relevant hydraulic line section is detected. This feature of the invention bypasses the failed line section and allows unencumbered operation of sliding sleeve 40 through the other hydraulic line section. If both hydraulic line sections 44C and 44D were to fail, sliding sleeve 38 can still operate by closing flow valves 68 and 70 and isolating sliding sleeve 38 from sliding sleeve 40 and other well tools in the well control system. Although this procedure would not likely permit the operation of sliding sleeve 40 without further intervention, sliding sleeve 38 would produce hydrocarbon fluids 54 without requiring repair operations.

In this embodiment of the invention, hydraulic power can be supplied to two or more well tools (such as sliding sleeves) with redundant hydraulic control line sections connected between each well tool. Preferably, these hydraulic line sections are attached to diametrically opposite sides of tubing 16 to minimize the risk of damage to both control line sections during installation and operation of the well tools. As described by the invention, hydraulic power is furnished to each well tool continues even if one or more of the hydraulic linw sections is simultaneously impaired.

In one embodiment of the invention, pressurized hydraulic fluid 54 is supplied to each tool such as the sliding sleeves illustrated in FIG. 1, and one-way valves such as solenoid valves 64 and 66 selectively bleed hydraulic fluid 54 into wellbore 14 as sliding sleeve 38 or similar tool is operated. This concept creates a unidirectional flow path for hydraulic fluid 54 as controlled by valves 64 and 66. This concept differs from available safety valves where the fluid backflows during the closure of the safety valve.

Figure 3:
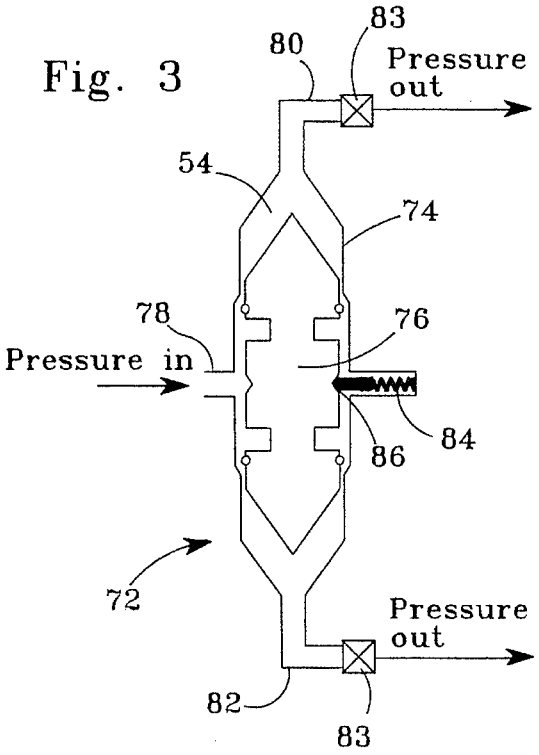
FIG. 3 illustrates an alternative embodiment of a redundant hydraulic line system.
Figure 4:
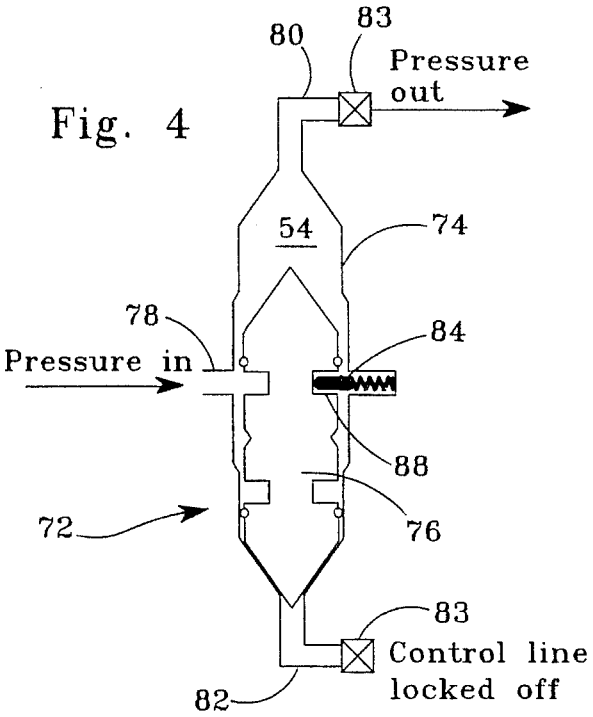
FIG. 4 illustrates a shuttle valve in a hydraulic system where the float is in the open position.

FIG. 3 illustrates an alternative embodiment of the invention showing a schematic drawing for redundant hydraulic line control system 72. System 72 generally comprises shuttle valve 74 having splitter or float 76 that operates as two check valves linked in parallel. Line 78 enters shuttle valve 74 and lines 80 and 82 exit shuttle valve 74. If float 76 experiences a back flow caused by a fluid leak in the direction of the back flow, float 76 will "check" or close against the respective seat in shuttle valve 74, as illustrated in FIG. 4, to inhibit the loss of hydraulic fluid 54 from the control system 72 through hydraulic line 82. If hydraulic lines 80 and 82 are properly functioning, float 76 will freely move within shuttle valve 74 without encumbering the movement of hydraulic fluid 54.

Flow fuses or check valves 83 can be positioned in hydraulic lines 80 and 82 to inhibit the flow of hydraulic fluid 54 through hydraulic lines 80 and 82. Each flow fuse 83 operates similar to a check valve having a ball held away from the seat by a spring. If such flow fuses are configured as a flow device sensitive to flow rates or pressure drops, the flow fuses will close when the flow rates or pressure drops exceed selected values. If the flow rate returns to the original amount, or if the differential pressure of hydraulic fluid 54 drops below the spring rating, the flow fuse "unchecks" and opens to permit fluid flow.

As shown in FIGS. 3–4, a hydraulic splitter or float 76 can selectively control the flow of hydraulic fluid 54 through the hydraulic lines. As shown in FIG. 3, normal operation of the line is illustrated where detent plunger 84 cooperates with recess 86 in float 76 to centrally retain float 76. In this configuration, hydraulic fluid 54 freely flows through lines 80 and 82. FIG. 4 illustrates a condition where a leak or other line impairment occurs in line 82. In this condition, the pressure differential acting across float 76 moves float 76 to seal the port of control line 82, and float 76 is retained in such position by the cooperation between detent plunger 84 and float recess 88. In this configuration, all hydraulic fluid 54 would be transmitted through line 80. Similarly, float 76 would move to block line 80 in the event of failure in hydraulic line 80.

The present invention efficiently provides control redundancy for downhole tools. If a leak or line blockage develops in a hydraulic line section, flow fuses and shuttle valves will cooperate to isolate the line section from further leakage.

This configuration permits overall system integrity if one or more hydraulic line sections become damaged or is otherwise impaired. Multiple line section failures are handled by this configuration provided that parallel line sections are not simultaneouly damaged or blocked. If parallel line sections are positioned at opposite sides of production tubing in a horizontal well application, the probability of simultaneous parallel line section failure is remote. The hydraulic control circuit is passive and responds automatically to line section leaks. The shuttle valves and flow fuses automatically cooperate to isolate a leaking or blocked line section.

To operate the well control system in one embodiment of the invention, surface control of the well over a certain number of well intervals or zones is performed. Electro-hydraulic valves can be positioned downhole in the well with each well tool to selectively isolate and communicate with wellbore 14.

Low power electronics modules can be located in each actuator for operating a downhole tool. Each actuator electronic module is environmentally engineered and protected to operate at high downhole temperatures and pressures. The electronic modules are commanded and interrogated by a dedicated controller such as surface controller 90 in FIG. 1 in a control room or other site at the well head. Surface controller 90 sends a suitably addressed command to one or more actuator electronic modules engaged with each well tool and receives information regarding the present status of each corresponding well tool. In alternative embodiments of the invention, each actuator electronic module can monitor temperature and pressure conditions at the respective tool location and then report such information to surface controller 90.

In a well control system where tools comprise valves such as sliding sleeves, surface controller 90 monitors the downhole status of each sliding sleeve or well tool, and then transmits signals to control the opening and closing of moving elements for operating the well tool. In conventional sliding sleeves having solenoid valves, each solenoid valve directs hydraulic pressure to the piston driving the closure mechanism within the sliding sleeve.

Control of each electronic module is achieved by sending DC power and modulated HF down instrument wire to the actuator control module engaged with each respective well tool. Commands can be transmitted by frequency shift keyed techniques. Each actuator control module has a distinct address identified by a digital code, and code redundancy can be applied by transmitting a complement version of the address code. The selected actuator electronic module operates the appropriate solenoid valve to move the sliding sleeve and then communicates the new position of each sliding sleeve to the surface controller. During any intermediate step, the actuator electronic module can turn off the solenoid valve to stop the movement of the sliding sleeve. The sliding sleeve can therefore be selectively moved to each of the following positions:

Closed—Sliding sleeve is in a closed position to prevent the flow of reservoir fluids;

Set—An initial position of the sliding sleeve for hydraulically setting the isolation or external casing packers;

Equalising—Pressure equalization acomplished through a small aperture to protect major seal faces;

Intermediate—A plurality of open positions can be accomplished to selectively permit or restrict the flow of fluids through the sliding sleeve; and Open—In the full open position, the maximum amount of fluids are permitted to flow through the sliding sleeve.

It will be appreciated that this well control system permits the real time transmittal of information to the surface controller, where such data can be processed and stored to record the movement of downhole tools and the reservoir response to such movement. This feature permits real time operation of the reservoir, and further permits the analysis to determine selected changes in operating procedures.

As described above, the "set" feature of the invention permits the setting of production packer 24 and zone packers 26, 28, and 30 with hydraulic fluid. Referring to FIG. 1, hydraulic line 92 extends from sliding sleeve 32 to production packer 24 and zone packer 26. Hydraulic line 94 extends from sliding sleeve 34 to zone packer 28, and hydraulic line 96 extends from sliding sleeve 36 to zone packer 30. In this fashion, such packers can be selectively set and released by the selective control of the corresponding hydraulic lines.

Figure 5:
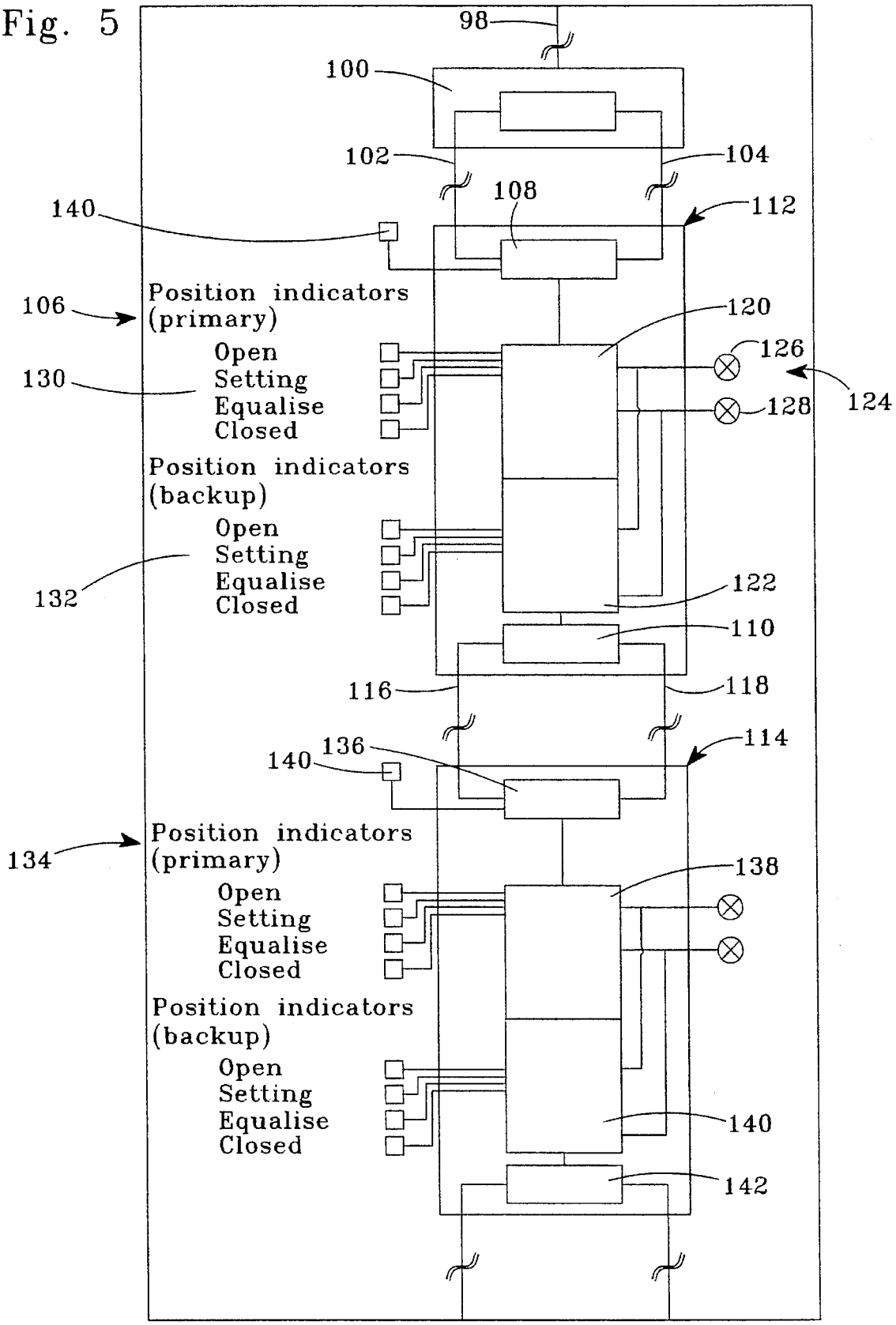
FIG. 5 illustrates a shuttle valve in a hydraulic system where the float has closed an impaired hydraulic line.

The redundancy provided for the hydraulic control components is similarly created for electric conductive elements in the wellbore. As shown in FIG. 5, single instrument wire or conductor 98 is connected to splitter module 100. Conductor 98 can be selected to reduce energy losses in and to maximze the power available to the well tools. In one embodiment of the invention, data signals can be transmitted through a coaxial or twisted assembly of insulated conductors having sufficient configuration and size to provide a two way communication link with surface controller 90. In one embodiment of the invention, splitter module 100 can be positioned below subsurface safety valve 20 shown in FIG. 1. Splitter module 100 is engaged with conductor section 102 and conductor section 104 which in turn are engaged with splitter module 106 in control module 106. As illustrated in FIG. 5, control module 106 generally comprises upper splitter module 108, lower splitter module 110, actuator electronics module 112, and actuator electronics module 114. Upper splitter module is engaged with conductor sections 116 and 118 and with actuator electronics modules 120 and 122. As shown, actuator electronics modules 120 and 122 are engaged in parallel with well tool such as sliding sleeve 124 through open solenoid valve 126 and close solenoid valve 128. Primary position indicator 130 is engaged with actuator electronics module 120 and indicates the open, setting, equalise, and closed positions of sliding sleeve 124. Similarly, backup position indicator 132 shows similar information through actuator electronics module 122.

Actuator electronics modules 120 and 122 are independent from each other, share a common power source, and are independently capable of controlling the operation of sliding sleeve 124 and of communicating data to surface controller 90. Actuator electronics modules 120 and 122 are isolated from each other so that failure of one does not interfere with the operation of the other. The selection of the actuator electronic module in use at any time is made by surface controller 90.

Power from upper splitter module 108 is transmitted to lower splitter module 110, which in turn is engaged with conductor sections 116 and 118. Conductor sections 116 and 118 are engaged with control module 134, which generally comprises upper splitter module 136 and actuator electronics modules 138 and 140 for operation as described above for control module 106. If another tool is located on tubing 16, lower splitter module 142 can be included for the same purpose described for lower splitter module 110.

The temperature and pressure of the formation fluids can be detected with guages such as guages 140. In one embodiment of the invention, quartz guages can be used instead of strain guages because of greater accuracy and superior drift characteristics.

The well tools can comprise a sliding sleeve having a full opening, concentric valve as an integral part of production tubing. Referring to FIG. 6, sliding sleeve 146 and valve 148 are illustrated. Composite thermoplastic chevron stacks 150 at each end of sliding sleeve 146 form a pressure communication barrier between tubing 16 and the annulus formed with wellbore 14. Seal bores above and below valve 148 facilitate the positioning of future staddles across sliding sleeve 146. Prepacked gravel screens (not shown) can be fitted to the outside diameter of sliding sleeve for sand control operations.

Consistent with the application of the invention described above, sliding sleeve 146 includes an electro/hydraulic system for communication with surface controller 90. A different sliding sleeve could be run in each zone in a multi-zone well formed with packers as described above. Each sliding sleeve contains electrically controlled solenoid actuated valves operated by a printed circuit board engaged with the surface controller, and the position of the valve is sensed and reported to surface controller. The sensing or detection of valve 148 location can be accomplished with magnet 152 attached to the movable element of valve 146, and a stationary sensor 154 for detecting the location of magnet 152. In a preferred embodiment of the invention, power to move the solenoid actuated valves is supplied by the hydraulic system described above.

In another embodiment of the invention, power to operate solenoid valves in a well tool can be furnished with a switching regulator atttached to the instrument wire or conductor. Well tools using solenoids or other moving components require power in the form o current to provide the moving force. Since the transmission of current through a conductor such as an instrument results in resistance losses, providing current to the well tool is not easily accomplished without experiencing excessive resistance losses.

To overcome this problem, one embodiment of the invention teaches that a switching regulator can be installed with a conductor such as instrument wire 46 to convert voltage into electric current. For example, electric power could be transmitted through instrument wire 46 at 120 volts and 100 milliamps and then converted by a switching regulator to 12 volts at two amps of current. Consequently, the unique application of a switching regulator may provide sufficient power to operate a well tool without requiring hydraulic pressure communicated through hydraulic line 44.

To install the one embodiment of the invention, external casing packers ("ECPs") known in the art can isolate production zones in the wellbore. Other packers such as open hole packers can perform a similar function. Each ECP can be set with a hydraulic control line ported into the adjacent control module (as shown in FIG. 1), and can be retrieved with a straight pull. ECPs are designed to set, pack off, and seal in open hole conditions such as in horizontal wells. As shown in FIG. 1, several ECPs are set in tandem to isolate intervals or zones between producing formations, and a downhole tool such as a sliding sleeves is positioned between adjacent ECPs to manage the flow of fluids from wellbore 14 into production tubing 16.

In another embodiment of the invention, the injection of chemicals into the wellbore can be regulated. If a low viscosity control fluid is used, a flow regulator is adequate to control the injection rate of the chemical. In one embodiment of the invention, hydraulic line 44 could conduct chemicals to a selected position downhole in a well. In this embodiment, lines 44 could replace ancillary chemical injection lines installed in the well, and valve 156 could release such chemicals to the well.

The present invention provides a novel well completion system that permits the independent, remote control of hydrocarbons from the well surface. The system will permit accurate reservoir characterization by permitting the actual production of selected production zones. This control is permitted without mobilization and lost production costs associated with existing procedures. These applications are particularly useful in remote subsea developments and in multi-zone horizontal completions requiring the selective isolation of water and gas producing zones. The well completion system further permits redundancy in zonal well control through conventional slickline or coiled tubing techniques.

In one unique application of the present invention, well tools such as sliding sleeves can be sheared from engagement with the actuating pistons if such pistons or the hydraulic lines become impaired. This feature permits the operation of the well tool with conventional wireline or coiled tubing techniques to continue operation of the well.

The present invention permits production engineers to regulate the efficiency of the well process control by controlling downhole flow characteristics. Control at the sandface and of the effectiveness of the data acquisition will facilitate the actual testing of different production profiles. Water producing zones can be shut off or choked back to improve vertical lift performance and to ease water treatment and disposal problems. The system further permits the control of gas breakthrough to provide gas lift and the consequential oil recovery from depleted zones.

The present invention further permits reservoir engineers to assess the effect of opening or closing a production interval and to determine the productivity index of each zone. Reservoir management of heterogeneous formations will be facilitated as the shut-in and flowing pressures and the mass flow of fluids are more easily measured and regulated. The pressure build-up or draw-down of each zone can be assessed, and the effects of cross flow during shut-in are eliminated. Material balance calculations are facilitated and will be more accurate because errors based on the analysis of commingled flow are eliminated.

The present invention further facilitates the maintenance of wells by reducing the need to run and pull guages, to set temporary plugs or to manipulate sliding sleeves. The need for certain logging procedures is reduced because the system provides well information without logging tool intervention. Treatment programs can be performed to selectively direct injection fluids at high rates into selected zones without downhole intervention. This feature of the invention minimizes the number of wireline or coiled tubing runs and further reduces the expense and risk associated with downhole intervention procedures.

Allthough the invention has been described in terms of certain preferred embodiments and procedures, it will be apparent to those of ordinary skill in the art that various modifications and improvements can be made to the inventive comcepts herein without departing from the scope of the invention. The embodiments described herein are merely illustrative of the inventive concepts and should not be interpreted as limiting the scope of the invention.

What is claimed is:

1. A well control system for communication between the surface of a well and a downhole well tool, comprising:

a surface controller at the well surface;

a hydraulic line engaged with the tool for providing pressurized hydraulic fluid to operate the tool;

a control means engaged with said hydraulic line and the well tool for selectively operating the well tool by discharging hydraulic fluid from the hydraulic line; and a conductor for transmitting electric signals between said surface controller and said control means.

2. A well control system as recited in claim 1, wherein said control means is capable of detecting a well condition and of communicating the well condition to said surface controller.

3. A well control system as recited in claim 1, wherein said control means is capable of operating the well tool in response to an electric signal transmitted through said conductor from said surface controller.

4. A well control system as recited in claim 1, further comprising a second control means engaged with said conductor and with a second well tool so that said conductor transmits electric signals between said surface controller and said second control means, and wherein said hydraulic line is engaged with the second well tool for providing hydraulic fluid power to operate the second well tool.

5. A well control system as recited in claim 1, wherein said control means is capable of detecting a well condition, of communicating the well condition to said surface controller through said conductor, and of receiving an electric signal from said surface controller for operating the well tool.

6. A well control system as recited in claim 1, wherein the well tool has a movable element having a magnetic source, and wherein said control means is responsive to said magnetic source and transmits an electric signal to signal movement of the movable element in the well tool.

7. A well control system as recited in claim 1, wherein said well tool includes a movable element for creating a flow path from the well annulus to the interior of said well tool so that well fluids can be transmitted to the well surface.

8. A well control system as recited in claim 7, wherein said control means is engaged with said movable element to selectively control the amount of well fluids flowing through said flow path.

9. A well control system as recited in claim 7, further comprising a pressure responsive tool engaged with said hydraulic line and with said control means, wherein the selective operation of said control means transmits hydraulic fluid pressure to said pressure responsive tool for selectively operating said tool.

10. A well control system as recited in claim 1, wherein said control means detects the temperature of fluids in the well.

11. A well control system as recited in claim 1, wherein said control means detects the pressure of fluids in the well.

12. A well control system as recited in claim 1, wherein said hydraulic line is adapted for discharging chemical from said hydraulic line.

13. A well control system as recited in claim 1, wherein said control means selectively controls the setting of a packer.

14. A well control system for operating a well tool, comprising:

a first hydraulic line containing pressurized fluid engaged with said tool for providing hydraulic power to operate said tool;

a second hydraulic line containing hydraulic fluid engaged with said tool for providing hydraulic power to operate said tool; and a valve engaged with said first hydraulic line and with said second hydraulic line for selectively operating to provide pressurized hydraulic fluid to said tool when the fluid carrying integrity of said first hydraulic line or said second hydraulic line is impaired.

15. A well control system as recited in claim 14, wherein said valve selectively blocks the flow of said hydraulic fluid into said first hydraulic line when said first hydraulic line develops a leak.

16. A well control system as recited in claim 14, wherein said valve selectively blocks the flow of said hydraulic fluid into said first hydraulic line when said first hydraulic line becomes at least partially blocked.

17. A well control system as recited in claim 14, further comprising a main hydraulic line having a first end at the well surface and having a second end attached to a hydraulic fluid splitter, wherein said fluid splitter distributes pressurized fluid to said first hydraulic line and to said second hydraulic line.

18. A well control system as recited in claim 14, further comprising a second valve engaged with said first hydraulic line and with said second hydraulic line, wherein said second valve provides pressurized fluid to a third hydraulic line engaged with a second well tool and provides pressurized fluid to a fourth hydraulic line engaged with said second well tool, and wherein said second valve selectively operates to provide hydraulic fluid to said second tool when the fluid carrying integrity of said third hydraulic line or said fourth hydraulic line is impaired.

19. A well control system as recited in claim 18, further comprising a third valve engaged with said third hydraulic line and with said second hydraulic line, wherein said second valve selectively operates to prevent the flow of hydraulic fluid into a hydraulic line that becomes impaired.

20. A well control system for operating a well tool, comprising:

a control module engaged with said tool for processing electric signals;

a first conductor engaged with said control module for transmitting electric signals;

a second conductor engaged with said control module for transmitting electric signals; and a surface controller engaged with said first conductor and with said second conductor for processing electric signals, wherein said surface controller selectively processes electric signals through said first conductor when the electric transmitting capacity of said second conductor is impaired, and wherein said surface controller selectively processes electric signals through said second conductor when the electric transmitting capacity of said first conductor is impaired.

21. A well control system as recited in claim 20, wherein said control module is capable of detecting an electric signal related to a well condition and is capable of transmitting such electric signal to said surface controller through said first conductor and second conductor.

22. A well control system as recited in claim 20, wherein said control module is capable of generating an electric signal and of selectively transmitting said electric signal through said first conductor when the electric transmitting capacity of said second conductor is impaired, and of selectively transmitting said electric signal through said second conductor when the electric transmitting capacity of said first conductor is impaired.

23. A well control system as recited in claim 20, wherein said surface controller transmits an electric signal to said control module through said first conductor and said second conductor for operating the well tool.

24. A well control system as recited in claim 20, further comprising a main conductor having a first end engaged with said surface controller, an electric splitter engaged with a second end of said main conductor and with said first conductor and said second conductor, wherein said electric splitter selectively controls the transmittal of electric signals through said first and second conductors.

25. A well control system as recited in claim 24, wherein said electric splitter transmits said electric signals through said second conductor when said first conductor becomes disabled.

26. A well control system as recited in claim 20, further comprising a third conductor engaged between said control module and a second control module attached to a second well tool, and further comprising a fourth conductor engaged between said control module and said second control module.

27. A well control system as recited in claim 26, wherein said second control module transmits electric signals through said fourth conductor when said third conductor becomes disabled.

28. A well control system as recited in claim 26, wherein said surface controller is capable of detecting electric signals transmitted by said control module and by said second control module regarding a well condition at the well tool and at the second well tool.

29. A well control system as recited in claim 28, wherein said surface controller is further capable of processing said electric signals to generate selected command signals.

30. A well control system as recited in claim 29, wherein said surface controller is further capable of transmitting said command signals to said control module and to said second control module to selectively control the operation of the well tool and the second well tool.

31. A method for operating a downhole well tool, comprising the steps of:

positioning a surface controller at the well surface;

placing a first hydraulic line in communication with a downhole well tool having a control module engaged with said downhole tool;

placing a second hydraulic line in communication with said downhole tool; and selectively closing said second hydraulic line if the fluid carrying capacity of said second hydraulic line becomes impaired.

32. A method as recited in claim 31, further comprising the steps of detecting a well condition with said control module, of generating a signal responsive to said well condition, and of transmitting said signal to said surface controller.

33. A method as recited in claim 32, further comprising the steps of processing said signal with said surface controller to generate an electric signal commanding said control module to operate said well tool.

34. A method as recited in claim 33, wherein said control module operates said well tool by releasing hydraulic fluid from said hydraulic line into the well.

35. A method as recited in claim 31, further comprising the steps of placing a hydraulic line system in communication between said hydraulic line and a second downhole well tool and of selectively controlling said hydraulic line system to operate the second downhole tool.

36. A method for operating a downhole well tool, comprising the steps of:

positioning a surface controller at the well surface;

placing a first conductor in communication with a downhole well tool having a control module engaged with said downhole tool;

placing a second conductor in communication between said surface controller and said control module; and selectively disabling said second conductor if the integrity of said second conductor becomes impaired.

37. A method as recited in claim 36, further comprising the steps of placing a second conductor system in communication between said control module and a second control module engaged with a second downhole well tool, and of transmitting electric signals between said surface controller and the second control module.

* * * * *